United States Patent [19]

Tsuji

[11] 4,362,579

[45] Dec. 7, 1982

[54] HIGH-STRENGTH-CONDUCTIVITY COPPER ALLOY

[75] Inventor: Masahiro Tsuji, Urawa, Japan

[73] Assignee: Nihon Kogyo Kabushiki Kaisha, Tokyo, Japan

[21] Appl. No.: 219,617

[22] Filed: Dec. 24, 1980

[30] Foreign Application Priority Data

Dec. 25, 1979 [JP] Japan ..... 54-167517

[51] Int. Cl.[3] ..... C22F 1/08

[52] U.S. Cl. ..... 148/11.5 C; 420/481

[58] Field of Search ..... 75/157.5; 148/11.5 C, 148/12.7 C, 32, 32.5

[56] References Cited

U.S. PATENT DOCUMENTS

| | | | |
|---|---|---|---|
| 1,954,003 | 4/1934 | Vaders | 75/157.5 |
| 2,028,317 | 1/1936 | Butterbaugh | 75/157.5 |
| 2,123,840 | 7/1938 | Bunn | 75/157.5 |
| 2,145,065 | 1/1939 | Vaders | 148/12.7 C |
| 3,337,335 | 8/1967 | Fearnside | 75/157.5 |
| 4,191,564 | 3/1980 | Hirao | 75/157.5 |

FOREIGN PATENT DOCUMENTS

| | | | |
|---|---|---|---|
| 160827 | 11/1964 | U.S.S.R. | 75/157.5 |

*Primary Examiner*—Peter K. Skiff

*Attorney, Agent, or Firm*—Seidel, Gonda, Goldhammer & Panitch

[57] ABSTRACT

A copper alloy with high strength and excellent electrical conductivity, corrosion resistance, and spring qualities, comprises 0.4–8% nickel, 0.1–3% silicon, 10–35% zinc, concomitant impurities, and the remainder copper, all by weight. It further comprises at least one element as an accessory ingredient or ingredients selected from the group consisting of 0.001–0.1 wt % each of phosphorus and arsenic and 0.01–1 wt % each of titanium, chromium, tin, and magnesium. The accessory ingredient or ingredients combinedly account for 0.001–2% of the total weight of the alloy composition.

2 Claims, No Drawings

HIGH-STRENGTH-CONDUCTIVITY COPPER ALLOY

BACKGROUND OF THE INVENTION

This invention relates to a copper alloy designed for springs, possessing high strength, desirable spring qualities, and excellent corrosion resistance and electrical conductivity and yet available at low cost, and also to a method of manufacturing the alloy.

Spring materials heretofore used to make springs for electrical machines, measuring instruments, and electrical parts, such as switches and connectors, have been three kinds of alloys, i.e., brass that is inexpensive, nickel silver excellent in spring properties and corrosion resistance, and phosphor bronze with superior spring qualities. However, brass is inferior in strength and other properties needed in springs. On the other hand, despite their excellent strength and spring qualities, nickel silver and phosphor bronze, which contain 18 wt % nickel and 8 wt % tin, respectively, are rather too expensive alloys because of the elements involved and the limitations in working including poor hot workability. Another disadvantage common to those alloys is low electrical conductivity in applications such as component parts of electrical machinery and appliances. A further disadvantage of phosphor bronze, in particular, is inadequate resistance to corrosive attacks. For these reasons there has been a great need for the introduction of an alloy inexpensive but highly conductive and excellent in corrosion resistance and properties useful in springs.

SUMMARY OF THE INVENTION

In view of the foregoing, the present invention is aimed at providing a copper alloy equivalent to or better than nickel silver and phosphor bronze in strength and spring qualities, superior to phosphor bronze and comparable to nickel silver in corrosion resistance, electrically more conductive than nickel silver and phosphor bronze and in addition, available at lower cost.

The copper alloy according to the invention comprises 0.4–8% nickel, 0.1–3% silicon, 10–35% zinc, concomitant impurities, and the remainder copper, all by weight. In another aspect, the copper alloy of the invention also comprises, as an accessory ingredient or ingredients, at least one element selected from the group consisting of 0.001–0.1% by weight each of phosphorus and arsenic and 0.01–1% by weight each of titanium, chromium, tin, and magnesium, said accessory ingredient or ingredients accounting for 0.001–2% of the total weight of the alloy composition. The alloy thus formed is characterized by high strength and excellent corrosion resistance, spring qualities, and electrical conductivity.

DETAILED DESCRIPTION

The grounds on which the proportions of the alloying elements are limited within the specific ranges in accordance with the invention will now be explained.

Nickel content is limited within the range of 0.4–8 wt %. If its content is less than 0.4 wt % a marked improvement in the spring qualities of the resulting alloy will not be expectable, even with the simultaneous addition of 0.1–3 wt% Si. The addition of Ni improves corrosion resistance, but the cost rises appreciably as its content increases. For this and other reasons the upper limit is put to 8 wt%.

The range for Si content is chosen to be 0.1–3 wt%. Less than 0.1 wt% Si will not materially improve the spring qualities of the product despite the addition of a specified amount of Ni. Also, while Si imparts added strength to the resulting alloy, more than 3 wt% Si will act synergetically with Ni to impair the hot workability of the alloy.

Zn, the addition of which is confined within the range of 10–35 wt%, improves the mechanical properties of the product. If the content of Zn is below 10 wt%, this effect will be negligible. On the other hand, it is wise economy to use as much Zn as possible but, for the stability of the material properties, the precipitation of the beta phase must be minimized (or preferably avoided). To this end the upper limit is fixed to 35 Wt%.

The balance is made up of Cu.

The above-mentioned accessory ingredients P, As, Ti, Cr, Sn and Mg give favorable effects upon the corrosion resistance, strength, or spring properties of the resulting alloy. However, the total proportion of such an ingredient or ingredients is limited to 0.001–2% of the total weight of the alloy composition, because a proportion below the range will not prove much effective while an excessive proportion will mar the cold working properties of the product. Particularly, it is preferable that each of the accessory ingredients is added in specified range set forth before.

As for the method of making the alloy of the invention, it is not quite dissimilar to that for the ordinary copper-base alloys. A heat treatment of the alloy following the final cold working improves the strength and other properties useful in springs. The heat treatment is done in the same way as with nickel silver and phosphor bronze, by the tension annealing, low temperature heat treatment, or other suitable technique.

The invention is illustrated by the following examples.

EXAMPLES

Electrolytic copper was melted in a graphite crucible, and Zn and then Ni and Si were added in varied amounts with or without the further addition of an accessory ingredient or ingredients. Each of the melts thus obtained was poured into a mold to form a casting, 30 mm in thickness. The castings were hot rolled at about 800° C. into plates 8 mm thick. The plates were further cold rolled into 2 mm-thick sheets, and the sheets in turn were heat treated at 750° C. for 5 minutes and cold rolled to the final thickness of 0.5 mm. The test pieces were subjected to low temperature annealing at 300° C. for one hour and were tested for their tensile strength, spring limit ($k_b$ value), spring fatigue limit, and electrical conductivity. The values obtained were as summarized in Table 1. For comparison with the alloy of the invention in the properties, 0.5 mm-thick cold-rolled sheets were formed of brass, nickel silver, and phosphor bronze in the same procedure as in the above alloys. The brass was annealed at a low temperature of 250° C. for one hour and the nickel silver and phosphor bronze at 300° C. for one hour. Those final products, too, were tested to determine their respective tensile strength, spring limit, spring fatigue limit, and electrical conductivity values. Table 1 again summarizes the results.

As can be seen from Table 1, the alloys made in accordance with the invention, as worked, are superior to the (65 Cu:35 Zn) brass and generally comparable to the nickel silver and phosphor bronze in both strength and spring properties and, upon low temperature annealing, they exceed the latter two in both respects. It is obvious, too, that the test pieces of the invention exhibit by far the better electrical conductivity values than those of the nickel silver and phosphor bronze.

TABLE 1

| Material | Worked material: Tensile strength (kg/mm²) | Worked material: Spring limit (kg/mm²) | Worked material: Bending numbers to failure (spring fatigue test at bending stress 40 kg/mm²) | Low-temp annealed material: Tensile strength (kg/cm²) | Low-temp annealed material: Spring limit (kg/mm²) | Low-temp annealed material: Bending numbers to failure (spring fatigue test at bending stress 40 kg/mm²) | Low-temp annealed material: Electrical conductivity (% IACS) |
|---|---|---|---|---|---|---|---|
| Conventional alloys: | | | | | | | |
| 65:35 Brass | 65.3 | 27.3 | $1.10 \times 10^4$ | 60.1 | 48.4 | $1.41 \times 10^4$ | 24.8 |
| Nickel silver (18% Ni) | 84.2 | 34.1 | $4.11 \times 10^4$ | 80.4 | 74.6 | $5.13 \times 10^4$ | 5.4 |
| Phosphor bronze Grade C(8% Sn) | 85.9 | 33.4 | $4.32 \times 10^4$ | 78.2 | 69.8 | $5.33 \times 10^4$ | 12.5 |
| Alloys of the invention (wt %: | | | | | | | |
| Cu-34.9% Zn-0.42% Ni-0.11% Si | 70.1 | 32.5 | $1.90 \times 10^4$ | 71.4 | 66.2 | $3.48 \times 10^4$ | 21.2 |
| Cu-29.89% Zn-1.46% Ni-0.33% Si | 80.2 | 34.3 | $4.79 \times 10^4$ | 89.2 | 81.7 | $6.13 \times 10^4$ | 20.3 |
| Cu-14.17% Zn-7.6% Ni-2.41% Si | 85.6 | 34.6 | $4.08 \times 10^4$ | 92.1 | 82.6 | $5.65 \times 10^4$ | 19.1 |
| Cu-29.62% Zn-1.46% Ni-0.34% Si-0.004% P | 80.6 | 34.1 | $4.82 \times 10^4$ | 89.8 | 82.6 | $6.37 \times 10^4$ | 19.8 |
| Cu-29.33% Zn-1.49% Ni-0.31% Si-0.07% Ti-0.26% Sn | 81.9 | 45.1 | $3.85 \times 10^4$ | 90.2 | 83.4 | $7.13 \times 10^4$ | 19.8 |
| Cu-29.62% Zn-1.46% Ni-0.36% Si-0.01% As-0.11% Mg-0.63% Cr | 84.2 | 46.7 | $4.19 \times 10^4$ | 91.8 | 85.6 | $5.74 \times 10^4$ | 19.2 |

Next, the corrosion resistance of the test pieces according to the invention will be considered. The pieces were thoroughly washed with acetone by the ultrasonic cleaning technique and were tested with salt water spray for 48 hours in conformity with the testing procedure of the Japanese Industrial Standards Z-2371. Table 2 presents a summary of the results.

Table 2 shows that Ni, Si, and accessory ingredients act altogether to increase the alloy resistance to the corrosive attack of salt water.

It is also clear that the alloy test pieces according to the invention are more corrosion-resistant than 65:35 brass and phosphor bronze Grade C and are comparable to or even superior to nickel silver in this respect.

As will be understood from the examples, the alloy of the present invention compares well with nickel silver and phosphor bronze in strength and spring qualities and exceeds the both in electrical conductivity. As regards corrosion resistance it is far superior to 65:35 brass and phosphor bronze and even better than nickel silver.

The alloy of the invention will permit reduction of cost or size when used, in place of nickel silver, phosphor bronze, and brass, for springs of electrical machinery and appliances, measuring instruments, and for such electrical parts as switches and connectors.

TABLE 2

| Test material | Condition of surface corrosion |
|---|---|
| Conventional alloys: | |
| 65:35 Brass | Entire surface was liver brown tinted. About 50% of the surface was dezincified. |
| Nickel silver (18% Ni) | Whole surface turned lightly milk white. |
| Phosphor bronze Grade C (8% Sn) | Became liver brown all over. |
| Alloys of the invention (wt %): | |
| Cu-34.9% Zn-0.42% Ni-0.11% Si | About 50% of the surface was lightly dezincified; the rest turned dark yellow. |
| Cu-29.89% Zn-1.46% Ni-0.33% Si | Whole surface was dark yellow colored. Corrosion was slight. |
| Cu-14.17% Zn-7.6% Ni-2.41% Si | Whole surface was dark yellow colored. Corrosion was slight. |
| Cu-29.62% Zn-1.46% Ni-0.34% Si-0.004% P | Yellow color darkened all over. Corrosion was very slight. |
| Cu-29.33% Zn-1.49% Ni-0.31% Si-0.07% Ti-0.26% Sn | Yellow color darkened all over. Corrosion was very slight. |
| Cu-29.62% Zn-1.46% Ni-0.36% Si-0.01% As-0.11% Mg-0.63% Cr | Yellow color darkened all over. Corrosion was very slight. |

What is claimed is:

1. A method of producing electrical parts such as switches, terminals and connectors, which comprises forming said electrical parts from a copper alloy having high strength and excellent electrical conductivity, corrosion resistance, and spring qualities, said alloy consisting of about 0.4–8 weight % nickel, about 0.1–3 weight % silicon, about 10–35 weight % zinc, concomitant impurities and the remainder copper.

2. A method of producing electrical parts such as switches, terminals and connectors, which comprises forming said electrical parts from a copper alloy having high strength and excellent electrical conductivity, corrosion resistance, and spring qualities, said alloy consisting of about 0.4–8 weight % nickel, about 0.1–3 weight % silicon, about 10–35 weight % zinc, concomitant impurities and the remainder copper, and said alloy further consisting of, as an accessory ingredient or ingredients, at least one element selected from the group consisting of:

| | |
|---|---|
| about 0.001–0.1% by weight | phosphorus |
| about 0.001–0.1% by weight | arsenic |
| about 0.01–1% by weight | titanium |
| about 0.01–1% by weight | chromium |
| about 0.01–1% by weight | tin |
| about 0.01–1% by weight | magnesium |

said accessory ingredient or ingredients combined accounting for about 0.001–2% of the total weight of said alloy.

* * * * *